US006274064B1

(12) United States Patent
Wheatley

(10) Patent No.: US 6,274,064 B1
(45) Date of Patent: Aug. 14, 2001

(54) METAL OXIDE CONTAINING GAS GENERATING COMPOSITION

(75) Inventor: Brian K. Wheatley, Marshall, VA (US)

(73) Assignee: Atlantic Research Corporation, Gainesville, VA (US)

( * ) Notice: Subject to any disclaimer, the term of this patent is extended or adjusted under 35 U.S.C. 154(b) by 0 days.

(21) Appl. No.: 09/438,407

(22) Filed: Nov. 12, 1999

Related U.S. Application Data

(62) Division of application No. 09/130,454, filed on Aug. 7, 1998, now Pat. No. 6,156,200.

(51) Int. Cl.[7] ..... C01B 21/087; C01B 21/20; C06B 31/32; C06B 45/10; C06B 29/16

(52) U.S. Cl. ..... 252/186.21; 252/186.2; 252/186.44; 252/187.31; 149/19.91; 149/47; 149/62; 149/76; 149/78; 280/741

(58) Field of Search ..... 149/19.91, 46, 149/47, 61, 62, 76, 77, 78; 280/741; 252/186.2, 186.21, 186.44, 187.31

(56) References Cited

U.S. PATENT DOCUMENTS

| | | | | |
|---|---|---|---|---|
| 3,056,702 | | 10/1962 | Linsk | 149/19 |
| 3,180,772 | | 4/1965 | O'Connor et al. | 149/47 |
| 3,352,727 | | 11/1967 | Cooley | 149/19 |
| 3,932,242 | * | 1/1976 | Bartley et al. | 149/19.9 |
| 5,372,664 | | 12/1994 | Neidert et al. | 149/19.8 |
| 5,482,579 | | 1/1996 | Ochi et al. | 149/83 |
| 5,538,567 | * | 7/1996 | Henry, III et al. | 149/18 |
| 5,557,151 | * | 9/1996 | Epstein et al. | 264/3.4 |
| 5,587,552 | * | 12/1996 | Dillehay et al. | 149/19.5 |
| 5,629,494 | | 5/1997 | Barnes et al. | 149/36 |
| 5,726,382 | * | 3/1998 | Scheffee et al. | 149/19.91 |
| 5,739,460 | * | 4/1998 | Knowlton et al. | 102/324 |
| 5,741,999 | * | 4/1998 | Kazumi et al. | 149/35 |
| 5,850,053 | * | 12/1998 | Scheffee et al. | 149/19.91 |
| 5,861,571 | * | 1/1999 | Scheffee et al. | 102/288 |
| 5,866,842 | * | 2/1999 | Wilson et al. | 149/19.6 |
| 6,156,230 | * | 12/2000 | Wheatley | 252/186.21 |

* cited by examiner

*Primary Examiner*—Joseph D. Anthony
(74) *Attorney, Agent, or Firm*—Nixon & Vanderhye P.C.

(57) ABSTRACT

A gas generating composition comprising ammonium nitrate and a non-toxic metal oxide which reduces the pressure exponent and enables the composition to sustain combustion at or near atmospheric pressure, thereby improving combustion efficiency. The composition is useful for various purposes, such as inflating a vehicle occupant restraint, i.e., an air bag for an automotive vehicle or aircraft, as well as aircraft escape chutes or the like.

7 Claims, 2 Drawing Sheets

METAL OXIDE CONTAINING GAS GENERATING COMPOSITION

This is a divisional of application Ser. No. 09/130,454, filed Aug. 7, 1998, now pending, the entire content of which is hereby incorporated by reference in this application now U.S. Pat. No. 6,156,200.

TECHNICAL FIELD

The present invention relates to gas-generating compositions for generating a particulate-free, non-toxic, odorless and colorless gas. The present invention is particularly useful in vehicle occupant restraints and aircraft chutes.

BACKGROUND ART

The present invention relates generally to inflator compositions and more particularly to solid inflator compositions useful as gas generators. Gas generating compositions must satisfy various criteria for optimal effectiveness. Gas generating compositions for use in vehicle occupant restraints, e.g., automobile or aircraft airbags must satisfy stringent criteria including toxicity requirements which are of concern in solid propellants for military or propulsion systems. Conventional gas generating compositions are plagued with problems, including a high pressure exponent, a low burning rate, poor combustion stability, and inadequate age-life stability. The inferior ballistic properties disadvantageously result in low gas yields and unburned, energetic residues which remain at the end of the normal burn interval. Not surprisingly, great demand has recently arisen for gas generating compositions which yield a high volume of gas and a low volume of solid particulates, and which exhibit a low pressure exponent and have low pressure combustion stability.

Attempts to improve existing gas generating compositions to impart these properties have been unsuccessful for various reasons. For example, the addition of certain modifiers such as organometallic and certain oxides produce exhaust products that are toxic in man-rated environments. Other additives previously utilized, while not producing toxic exhaust products, have not successfully improved low pressure combustion efficiency. Also, other traditional techniques to solve these problems involve the use of relatively expensive degflagrative additives that interfere with the thermal or chemical stability of the overall formulation during long term thermal soak or thermal cycling conditioning.

Those skilled in this art have experienced difficulty in selecting among the many possible additive candidates for gas generating compositions intended for airbag applications to obtain compositions where smoke and ash are considered unacceptable consequences.

Moreover, propellant compositions are typically compacted into the form of grains of a suitable shape. Such propellant grains must be capable of sustaining thermal and tensile shock during igniter functioning, and must exhibit sufficient strength to remain intact during gas generator functioning if ballistic performance is to remain unaffected. The grains must retain such capability after aging and cycling.

There exists a continuing need for gas generating compositions, particularly gas generating compositions for air bag utility, which exhibit a low pressure exponent, high burning rate and good combustion efficiency at low pressures.

DETAILED DESCRIPTION OF THE INVENTION

Ammonium nitrate (AN), is conventionally employed as an oxidizer in gas generating compositions which include, as a component, guanidine nitrate (GN) because of its low cost, availability and safety. For example, a commercially available gas generating composition is ARCAIR 102A which is disclosed in U.S. Pat. No. 5,726,382 and includes guanidine nitrate, ammonium nitrate, potassium nitrate and polyvinyl alcohol.

Another commercially available gas generating composition is ARCAIR 102B which is disclosed in application Ser. No. 08/663,012 filed Jun. 7, 1996 now U.S. Pat. No. 5,850,053, and includes guanidine nitrate, ammonium nitrate, potassium perchlorate, and polyvinyl alcohol. A conventional airbag gas generating composition is disclosed in U.S. Pat. No. 5,538,567 to Olin. The '567 gas generating composition includes guanidine nitrate, an oxidizer, a flow enhancer and a binder. However, conventional airbag gas generating compositions such as the one disclosed in the patent might exhibit one or more disadvantages such as a high pressure exponent, a low burning rate, and poor combustion efficiency.

The present invention addresses and solves such problems by incorporating a strategically selected additive such as a metal oxide, e.g., iron oxide, in AN/GN compositions which surprisingly and unexpectedly improves the ballistic properties of AN-oxidized propellants, in particular, those containing GN or guanidine derivatives as highly oxygenated fuel sources. The composition, when in the form of a pressed pellet provides a generator to produce a particulate-free, non-toxic, odorless and colorless gas for inflating an air bag, without the tendency of the pellet to crack and with reduced phase change of the AN due to temperature cycling. Also, the pressure exponent is lowered, and low pressure combustion efficiency is improved. Furthermore, the addition of iron oxide does not adversely affect thermal stability of the base mix.

Accordingly, it is an object of the present invention to provide a gas generating composition which exhibits a lower pressure exponent and sustains combustion at pressures between ambient and 200 psi.

Another object of the present invention is to provide a method of generating a particulate-free, non-toxic, odorless and colorless gas.

According to the present invention, the foregoing and other objects are achieved in part by a gas generating composition comprising ammonium nitrate and a non toxic metal oxide.

Another object of the present invention is a method of generating a gas comprising the steps of a) providing an enclosed pressure chamber having an exit port, b) disposing within said chamber, a gas generating composition comprising ammonium nitrate and a non-toxic metal oxide, and c) providing means for igniting said composition upon detection of the pressure chamber being subjected to a sudden deceleration, whereby gas is instantly generated and conducted through the exit port of said pressure chamber.

Additional objects and advantages of the present invention will become readily apparent to those skilled in this art from the following detailed description, wherein only the preferred embodiment of the invention is shown and described, simply by way of illustration of the best mode contemplated for carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

THE DRAWINGS

Figure 1:
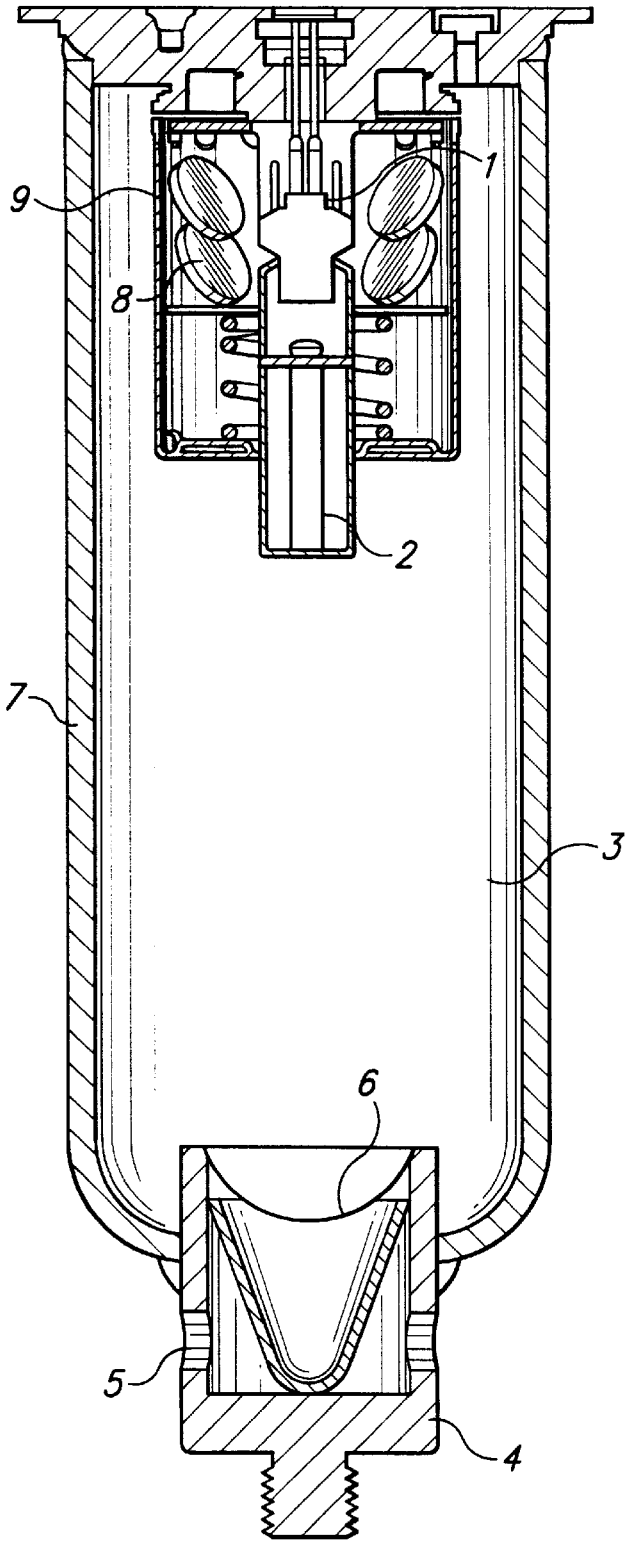
FIG. 1 is a side elevational view in section of a conventional passenger side inflator.

FIG. 1 depicts a conventional hybrid apparatus for use in the generation of gas to inflate an automotive vehicle air bag. As is readily seen from the drawing, the outlet ports are provided at the extreme right of the device.

In FIG. 1, the initiator (1) ignites in response to a sensor (not shown) that senses rapid deceleration indicative of a collision. The initiator generates hot gas that ignites the ignition charge (2) which causes the main generant charge (8) to combust, mix with an inert gas in the pressure tank (7) and generate the inflation gas mixture (3). When the pressure in the gas mixture increases to a certain point, the seal disc (6) ruptures permitting the gas mixture to exit the manifold (4) through the outlet ports (5) and inflate an air bag (not shown). The generant container (9) holds the main generant charge (8). All the charges and the inflation gas mixture are enclosed in the pressure tank (7).

Figure 2:
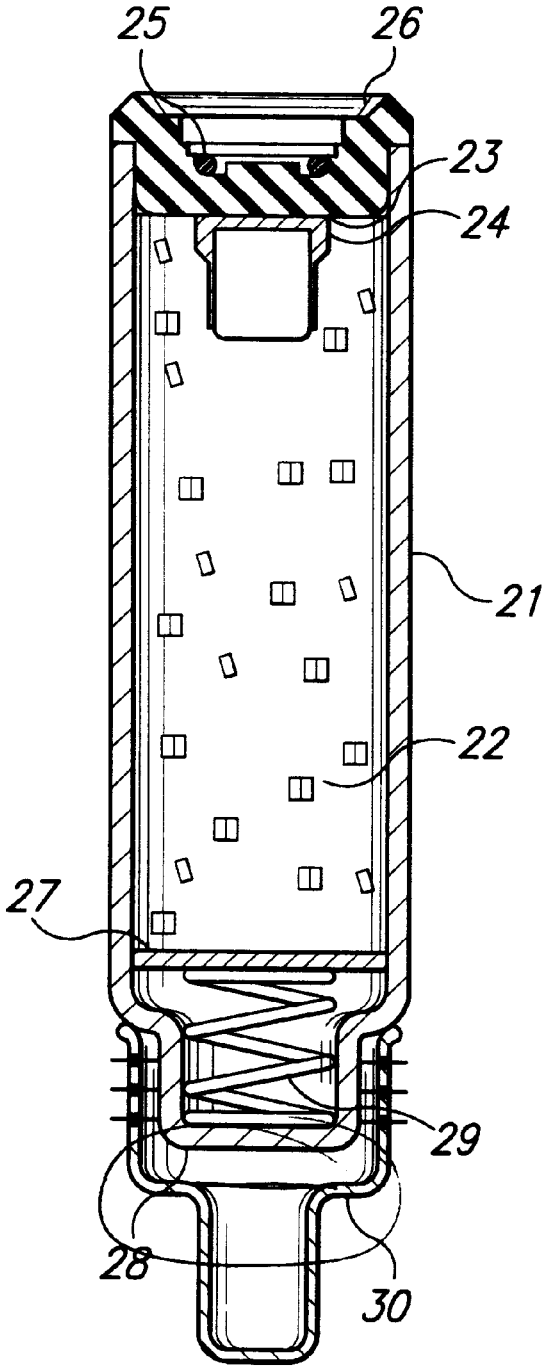
FIG. 2 is a side elevational view in section of a conventional pyrotechnic generator.

FIG. 2 is a drawing of the pyrotechnic generator of the instant invention. Since no part of the inflator is reserved for storage capacity, the device is smaller than its counterpart hybrid inflator. A cartridge (21) holds a generant (22), which may be a composition according to the present invention. At one end of the cartridge (21) is an initiator (23) that will combust in response to a signal from a sensor (not shown) which generates the signal as a result of a change in conditions, e.g., an excessive increase in temperature or a sudden deceleration of a vehicle (indicative of a crash), in which the inflator is installed. The initiator (23) is held in place by an initiator retainer (24). An O-ring (25) serves as a gasket to render the inflator essentially gas tight in the end where the initiator (23) is located.

The end of the inflator opposite from that containing the initiator (23) holds a screen (27) upon which any particulates in the produced gas are retained, a spring (29) to maintain dimensional stability of the generant bed, and a burst disc (28), which is ruptured when the gas pressure exceeds a predetermined value, permitting the gas to escape from the cartridge (21) through exit ports (not shown) situated like those in FIG. 1. To ensure that the expelled gas is not released in an unduly strong stream, a diffuser (30) is affixed to the discharge end of the inflator.

DESCRIPTION OF THE PREFERRED EMBODIMENTS

In accordance with the present invention, an additive comprising a metal oxide, e.g. $Fe_2O_3$, is strategically incorporated in AN/GN gas generating compositions which results in an attendant lowering of the pressure exponent and a significant increase in combustion efficiency. As metal oxides, particularly $Fe_2O_3$ result in the generation of smoke and ash, such metal oxides would not be considered as suitable additives for incorporation in airbag gas generating compositions. However, upon extensive experimentation and investigation, it was found that the addition of about 0.25 to about 2% by weight of iron oxide, preferably $Fe_2O_3$, results in an unexpectedly significant improvement in ballistic properties. It further appears that higher amounts of iron oxide, e.g., 10% or more, would also improve ballistic properties in certain propellant compositions.

The metal oxide component of the present compositions should produce non-toxic exhaust products, i.e., base metals or metal oxides. Examples of suitable metal oxides are oxides of Ti, Fe, Tn, strontium, bismuth, aluminum, magnesium, copper, silicon, boron and rare metals. Inclusion of the metal oxide reduces the pressure exponent of the propellant composition and advantageously enables the composition to sustain combustion at low pressure, e.g. at atmospheric pressure. It was found that the efficiency of the burning rate increases with increasing specific surface area of the metal oxide. It was further found that a specific surface area of from about 10 $m^2$/gm to about 1000 $m^2$/gm, such as from about 50 $m^2$/gm to about 750 $m^2$/gm, for example, from about 100 $m^2$/gm to about 500 $m^2$/gm achieves particularly desirable results. Preferred metal oxides are iron oxides, particularly, ferric oxide, i.e. $Fe_2O_3$. Various grades of iron oxide may be used. A particularly well suited iron oxide is NANOCAT superfine iron oxide which is commercially available from MACH I, Inc., of King of Prussia, Pa. The metal oxide may be present in the range of from about 0.25% to about 10%, more preferably in the range of from about 0.5% to about 5.0%, and most preferably in the range of from about 0.5% to about 2.0%. All percentages (%) throughout the specification mean percent by weight unless otherwise indicated.

Iron oxide was evaluated in both ARCAIR 102A and ARCAIR 102B propellants at levels of up to 2%. Effects on burning rate were minor. The pressure exponent was reduced in some cases to approximately 0.8 between 1,000 and 4,000 psi. The exponent drop was due to a drop in rate at higher pressure. This effect is unlike the action of iron oxide in an AP-oxidized propellant where the rate is usually increased at low pressure. The effects of iron oxide were more pronounced in ARCAIR 102A versus ARCAIR 102B propellant. Open-air burning tests were performed on pressed pellets of ARCAIR 102B propellant with and without iron oxide. Nanocat yielded a more vigorous flame than Harcros iron oxide from Harcros Chemicals Inc. of Kansas City, Kans. Both mixes with iron oxide produced a weak, but stable flame at ambient pressure, whereas the plain ARCAIR 102B would not sustain combustion. Iron oxide did not adversely affect hazard properties, aging or cycling stability of the propellant. Compressive strength of pressed pellets was reduced slightly.

The effect of iron oxide on temperature sensitivity, and combustion efficiency at low temperatures (i.e., −40° C.) was evaluated in motor tests (Table 4.1–2). A series of motor tests were made at −40° C. using extruded ARCAIR 102B containing zero, 0.5, 1.0 and 2.0 percent Nanocat superfine-iron-oxide. The tests were performed at nearly constant Kn of approximately 780. At −40° C., the mixes without iron oxide exhibited a high degree of scatter in the bottle pressure and total pressure integral relative to the mixes containing Nanocat, and the average combustion efficiency was low. The performance of the Nanocat was similar for contents ranging between 0.5 and 2.0 percent. Nanocat was superior to Harcros iron oxide which has a larger particle size and lower surface area. These data show that low levels of Nanocat were effective in improving combustion efficiency of ARCAIR 102B propellant. At ambient temperatures of approximately 21° C., the chamber pressure and performance of plain ARCAIR 102B propellant is similar to the iron oxide containing mixes. Therefore, the temperature sensitivity of pressure ($\pi_k$) between −40° and 21° C., is dramatically improved by the presence of iron oxide.

TABLE 4.1-2

Comparison of Average Ballistic Data Showing Iron Oxide Effects at −40° C.

| Propellant Type | # shots | Average Kn[1] | Average $P_c$ psi[2] | Average integral (P/T) psi-sec[3] | Efficiency % (average)[4] |
|---|---|---|---|---|---|
| Plain ARCAIR 102B | 6 | 784 | 2585 | 56 | 40 |
| 102B with 0.5% Nanocat | 3 | 786 | 6721 | 132 | 96 |
| 102B with 1.0% Nanocat | 3 | 782 | 6785 | 130 | 95 |
| 102B with 2.0% Nanocat | 4 | 773 | 5905 | 126 | 92 |
| 102B with 2.0% Harcros | 4 | 775 | 4941 | 114 | 83 |

[1]$K_n$ = the ratio of burning surface area to throat cross-sectional area
[2]$P_c$ = peak chamber pressure
[3]P/T = pressure − time integral
[4]Efficiency = the ratio of delivered P/T to theoretical P/T based on theoretical C Ammonium nitrate (AN) is a commonly used oxidizer since it gives high gas horsepower per unit weight and yields a non-toxic and non-corrosive exhaust at low flame temperatures. Further, it contributes to burning rates lower than those of other oxidizers, is inexpensive, readily available and safe to handle. The AN may be either part AN or an AN that contains phase stabilization additives and anti-caking additives. AN may be present in the range of from about 40% to about 80%, more preferably in the range of from about 50% to about 70%, and most preferably in the range of from about 55% to about 65%.

Guanidine derivatives suitable for use in the present invention include, for example, aminoguanidine nitrate (AGN), guanidine nitrate (GN), triaminoguanidine nitrate (TAGN), diaminoguanidine nitrate (DAGN), and ethylenebis-(amino-guanidinium) dinitrate. The guanidine derivative may be present in the range of from about 10% to about 50%, more preferably in the range of from about 20% to about 40%, and most preferably in the range of from about 25% to about 35%.

The compositions of the present invention may further comprise one or more salts of alkali metals such as nitrates or perchlorates. Preferred salts of an alkali metal are potassium and cesium nitrate and perchlorate salts. The nitrate salt of an alkali metal may be present in the range of from about 1% to about 20%, such as from about 3% to about 7%, for example, from about 4% to about 6%. The perchlorate of the alkali metal may be present in the range of from about 1% to about 20%, such as from about 3% to about 15%, for example, from about 9% to about 12%. An equivalent formulation can be prepared from an aqueous mix of ammonium perchlorate and potassium nitrate which yields the same concentration of K+ and $C10_4^-$ ions along with $NO_3^-$ in solution and $NH_4^+$ ions.

The compositions of the present invention preferably are processed to form a eutectic mixture or solid solution, and may also further comprise a minor amount of a water-soluble organic binder. A wide range of molecular weights and grades may be used. The water-soluble organic binder may comprise cellulosics, such as cellulose acetate butyrate, polyvinyl alcohol (PVA), hydroxy terminated polybutadiene (HTPB), polyesters and/or epoxies. The water-soluble organic binder may be present in the range of from about 1% to about 10%, more preferably in the range of from about 3% to about 7%, and most preferably in the range of from about 3% to about 6%.

Additives conventionally employed in gas generating compositions can also be incorporated, provided they are not inconsistent with the objectives of the present invention.

Dried products may be granulated to various particle sizes depending on end-form and use, which may take the form of granules, powders, pressed pellets, or extruded shapes. Often, the,end use requires a particle size distribution ranging from −18 to −40 mesh (U.S. Standard Sieve). Cut fractions may be recycled through the process.

Batch characterization and qualification may be accomplished by a series of tests, the most important of which include (1) thermal stability under accelerated aging conditions including dimensional, strength, and weight stability; (2) cycling stability over the full range of environmental temperatures including dimensional and compressive strength; (3) ballistic properties; and (4) hazard properties including impact, friction, static, and thermal sensitivity.

Thermal and stability test samples have been nominally aged for 17 days at 107° C., and have been exposed in excess of 3000 hours without significant loss in pellet properties. Similarly, samples are cycled between temperature extremes of −40 and +107° C. for 200 cycles, although intervals of up to 800 cycles have been evaluated with good success. At the conclusion of a series of tests, the exposed samples have been tested and compared to baseline properties.

Ballistic properties are measured using standard nitrogen bomb apparatus fitted with a pressure surge tank to maintain constant pressure and through the use of heavy-wall motor tooling that simulates the "end-item-configuration", or through the use of "slot-acceptance-test (LAT) tooling in the "end-item-configuration". Ballistic testing is nominally conducted over a range of pressures that brackets the operational pressure range of the delivered unit (i.e., AMBIENT to 10,000 psi).

Hazard properties are measured using industry standard ABL friction apparatus, BM impact tester, static sensitivity at 5000 volts, and thermal sensitivity using a Dupont 2000 or equivalent differential scanning calorimeter (DSC).

EXAMPLES

Tables 1 and 2 show that iron oxide levels of 2% are effective in reducing the pressure exponent in the pressure range of 1,000 to 4,000 psi from approximately 1.0 down to 0.8 to 0.85. The data further demonstrates that the addition of iron oxide permitted sustained combustion at atmospheric pressure. In contrast, the comparative composition which is free of iron oxide did not sustain combustion below 200 psi.

TABLE 1

| Mix # | 93 | 576 | 615 |
|---|---|---|---|
| Iron Oxide Type & Content | None | NANOCAT, 2% | HARCROS, 2% |
| Oxide surface area, $m^2$/gm | | 250 | 16–20 |
| Ingredients | Base Mix | Base + 2% Nanocat (98/2) | Base + 2% Harcros (98/2) |
| weight percent ash, % | 3.42 | 5.42 | 5.42 |
| Burn. Rate, in/sec @ | | | |
| 1000 psi | .18 | .20 | .16 |
| 2000 psi | .39 | .36 | .28 |

TABLE 1-continued

| Mix # | 93 | 576 | 615 |
|---|---|---|---|
| 4000 psi | .76 | .64 | .52 |
| exponent (1–2K) | 1.12 | .85 | .81 |
| exponent (1–4K) | 1.04 | .84 | .85 |
| Thermal Stability: | | | |
| Baseline Dia./ Stress in./psi 200 cycles | .522/5812 | .522/6691 | .522/8252 |
| diam. in. | .528 | .527 | .527 |
| stress, psi | 7862 | 7547 | 7621 |
| 17 day @ 107° C. | | | |
| diam., in. | OK | .528 | .524 |
| stress, psi | OK | 7104 | 8463 |

TABLE 2

| ARCAIR-102B Variation | Approx. Surface Area of $Fe_2O_3$ $m^2$/gm | Minimum Pressure to Combust psi |
|---|---|---|
| 102B baseline | — | 200 |
| With Nanocat (2%) | 200 | 14.7 |
| With Harcros iron oxide (2%) | 16–20 | 200 |
| With BASF iron oxide (2%) | 100 | 50 |

Only the preferred embodiments of the invention and examples of its versatility are shown and described in the present disclosure. It is to be understood that the invention is capable of use in various other combinations and environments and is capable of changes or modifications within the scope of the inventive concept as expressed herein.

What is claimed is:

1. A method of generating a particulate-free, non-toxic, odorless and colorless gas, comprising the step of igniting within an enclosed pressure chamber a gas generating composition which comprises a mixture of:

ammonium nitrate;

guanidine nitrate and/or aminoguanidine nitrate; and a non-toxic iron oxide having a surface area of between about 5 $m^2$/gm to about 1000 $m^2$/gm, and being present in an amount between about 0.25 to 10% by weight of the composition sufficient to achieve sustained combustion at atmospheric pressure and improved cold temperature combustion efficiency.

2. The method of claim 1, comprising igniting a eutectic or solid solution of the composition.

3. A method of generating a particulate-free, non-toxic, odorless and colorless gas, comprising the step of igniting within an enclosed pressure chamber a gas generating composition which comprises a eutectic mixture or a solid solution of:

(a) ammonium nitrate, (b) guanidine nitrate and/or aminoguanidine nitrate, (c) an iron oxide, (d) a salt of an alkali metal, and (e) a water-soluble organic binder, wherein said iron oxide has a surface area of between about 5 $m^2$/gm to about 1000 $m^2$/gm, and is present in an amount between about 0.25 to 10% by weight of the composition sufficient to achieve sustained combustion at atmospheric pressure and improved cold temperature combustion efficiency.

4. The method of claim 3, wherein the salt is potassium nitrate and the binder is polyvinyl alcohol.

5. The method of claim 3, wherein the salt is potassium perchlorate, and the binder is polyvinyl alcohol.

6. A method of generating a particulate-free, non-toxic, odorless and colorless gas, which method comprises:

a) providing an enclosed pressure chamber having an exit port, b) disposing within said chamber a gas generating composition, which composition comprises a mixture of ammonium nitrate; guanidine nitrate and/or aminoguanidine nitrate; and a non-toxic iron oxide having a surface area of between about 5 $m^2$/gm to about 1000 $m^2$/gm, and being present in an amount between about 0.25 to 10% by weight of the composition sufficient to achieve sustained combustion at atmospheric pressure and improved cold temperatures combustion efficiency, and c) providing means for igniting said composition upon detection of the pressure chamber being subjected to a sudden deceleration, whereby gas is instantly generated and conducted through the exit port of said pressure chamber.

7. The method according to claim 6, conducted in an automotive vehicle equipped with at least one air bag, wherein the generated gas passes through the exit port, and enters the air bag to inflate it.

* * * * *